United States Patent [19]

Arnn

[11] 4,105,056

[45] Aug. 8, 1978

[54] NONSLIP SCREW DRIVER

[76] Inventor: Edward T. Arnn, 505 Country La., Louisville, Ky. 40207

[21] Appl. No.: 621,735

[22] Filed: Oct. 14, 1975

Related U.S. Application Data

[63] Continuation-in-part of Ser. No. 491,361, Jul. 24, 1974, Pat. No. 3,923,088, which is a continuation-in-part of Ser. No. 473,840, May 28, 1974, Pat. No. 3,897,812.

[51] Int. Cl.[2] ..... B25B 15/00

[52] U.S. Cl. ..... 145/50 A; 145/50 D

[58] Field of Search ..... 145/50 A, 50 D, 50 R

[56] References Cited

U.S. PATENT DOCUMENTS

| | | | |
|---|---|---|---|
| 685,197 | 10/1901 | Barnes | 145/50 A |
| 1,479,506 | 1/1924 | Kellemen | 145/50 A |
| 1,899,489 | 2/1933 | Wickbergh | 145/50 A |
| 2,116,775 | 5/1938 | Blackburn | 145/50 A |
| 2,566,055 | 8/1951 | Daderkd et al. | 145/50 D |
| 2,567,466 | 9/1951 | Bartlett | 145/50 D |
| 2,676,510 | 4/1954 | Hodell | 145/50 A |
| 2,994,354 | 8/1961 | Vaughn | 145/50 A |
| 3,695,321 | 10/1972 | Garehime | 145/50 A |

FOREIGN PATENT DOCUMENTS

| | | | |
|---|---|---|---|
| 22,718 of | 1910 | United Kingdom | 145/50 A |
| 178,160 | 4/1922 | United Kingdom | 145/50 D |

*Primary Examiner*—James L. Jones, Jr.
*Assistant Examiner*—J. T. Zatarga

[57] ABSTRACT

A screw driver having a foot portion on the lower extremity of its blade which includes opposed upstanding faces of a height less than the depth of a screw slot into which they are inserted to increase the effectiveness of the blade in gripping the sidewalls of a screw slot and yet provide a durable wear resistant screw driver.

4 Claims, 6 Drawing Figures

NONSLIP SCREW DRIVER

CROSS REFERENCE TO RELATED APPLICATION

This application is a continuation in part of U.S. Pat. application Ser. No. 491,361 filed July 24, 1974 now U.S. Pat. No. 3,923,088 which is a continuation in part of U.S. Pat. application Ser. No. 473,840 filed May 28, 1974, now U.S. Pat. No. 3,897,812.

BACKGROUND OF THE INVENTION

It has been long recognized that present day screw drivers fall far short of being adequate to insert or remove screws which have substantial resistance to turning. Most typically, if a screw has a substantial resistance to being turned, upon applying a torque thereto, the screw driver blade slips upwardly out of the slot in the screw head. This slippage is an undesirable result arising from the current screw driver blade geometry.

Many attempts have been made to modify screw driver blades to make them perform better when in use on "difficult-to-turn" screws. Representative of these attempts are U.S. Pat. Nos. 3,236,275; 2,684,094 and 370,255. Generally, these attempts have included modifying the screw head as well as the screw driver blade. However, modification of the screw head is impractical, since screws currently in use do not have modified heads and industry acceptance of any modification is a major obstacle. Another approach is to modify the screw driver blade by providing ribs which project downwardly on each side of the screw head as shown in U.S. Pat. No. 697,836. However, such a screw driver is generally unacceptable since the screw head must be protruding above any adjacent surfaces in order for the screw driver to be used.

Also, it has become important from a quality control point of view to avoid burring the upper edges of the screw slot during its insertion into its final use position. None of the prior art screw drivers suggest a means of avoiding such burring.

The invention of this application is a rugged, inexpensive, readily constructed and easily employed screw driver which overcomes all of the defects of prior art screw drivers.

SUMMARY OF THE INVENTION

The present invention relates to a screw driver including a blade, having a lower foot portion which protrudes outwardly from the blade faces to provide a gripping means. The foot portion includes upstanding faces adjoining the base of the foot portion. The upstanding faces are of a height which is less than the depth of the screw slot into which the screw driver blade is inserted to thereby provide a limited area at the lower most portion of the screw slot to enhance the torque transmitting properties of the blade and to avoid burring the upper edges of the slot.

More specifically, the invention includes a screw driver comprising a shank portion and a blade portion integral therewith, said blade portion terminating at its free end in a foot portion, said foot portion being integral through a smooth transition portion with said blade and being generally pentagon shaped in side cross-section with one side defining a base portion lying in a plane generally perpendicular to the axis of the shank and being engagable with the bottom of a slot having generally parallel sidewalls of a preselected depth in a screw head, said foot portion further having two opposed sides defining upstanding faces adjoining the base of the foot portion and extending across the entire width of the blade, said upstanding faces being of a height less than the depth of said screw slot and thereby engagable with at least the lower portion of said parallel sidewalls of said screw slot to transmit torque thereto, said upstanding faces terminating respectively at inwardly sloping sidewalls which define the uppermost portion of said foot portion, said inwardly sloping sidewalls extending the entire width of said blade and being integral with said transition portion which in turn is integral with said blade.

The screw driver of this invention has been found to be capable of transmitting a torque to a screw head which is greater than the torque that can be transmitted by a conventional screw driver. Also, the screw driver of this invention has been found to be resistant to being dislodged once inserted into a screw head slot and subjected to a torque. In addition, the screw driver of this invention can engage a screw head from an angle other than straight on and still provide its superior torque transmitting qualities. Also, the screw driver of this invention has been found not to burr the upper edges of a screw slot when used to turn a screw; and, lastly, the screw driver of this invention allows a user to position a screw thereon by first engaging one upstanding face of the blade foot portion in a screw head slot and then with a rocking motion engaging the other upstanding face in the slot, whereupon the screw is removably held by the foot portion and easily positioned in a hole not otherwise accessible to a screw.

DESCRIPTION OF THE PREFERRED EMBODIMENT

Figure 1:
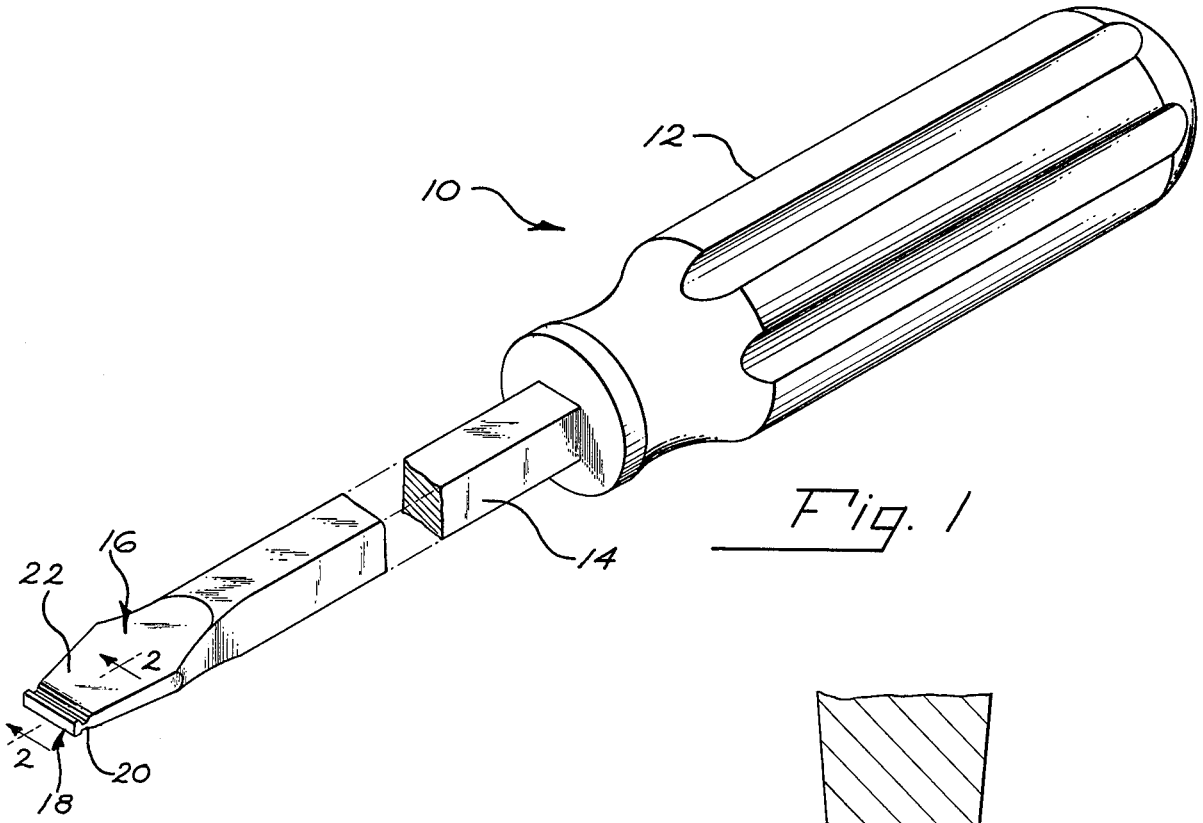
FIG. 1 is an isometric view of the screw driver of this invention.
Figure 2:
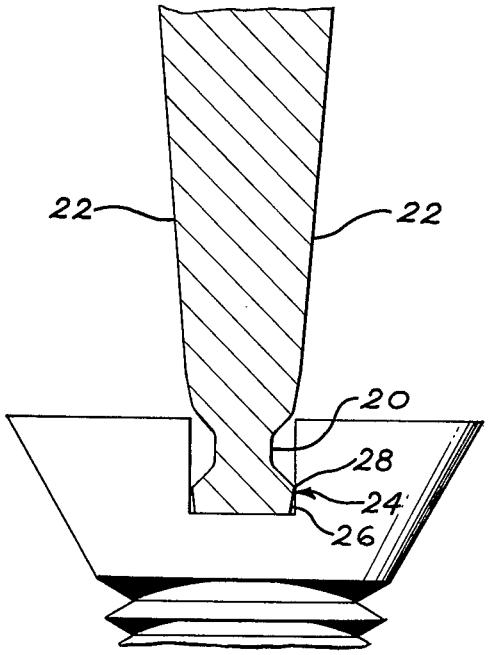
FIG. 2 is a sectional view taken along line 2—2 of FIG. 1.
Figure 3:
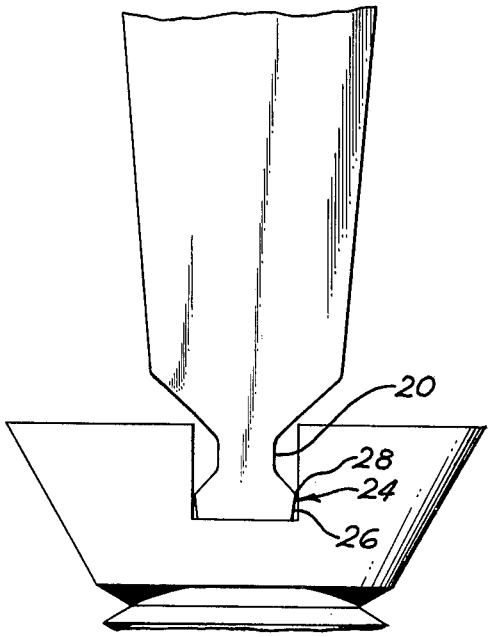
FIG. 3 is a sectional view similar to FIG. 2 showing an alternative embodiment of the screw driver of this invention.
Figure 4:
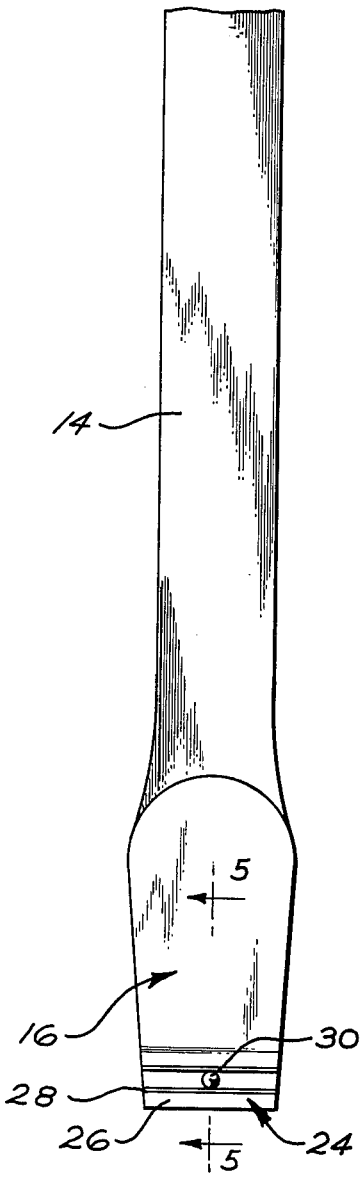
FIG. 4 is a front view of the screw driver of FIG. 3 showing in addition a screw holding means located above the foot portion.
Figure 5:
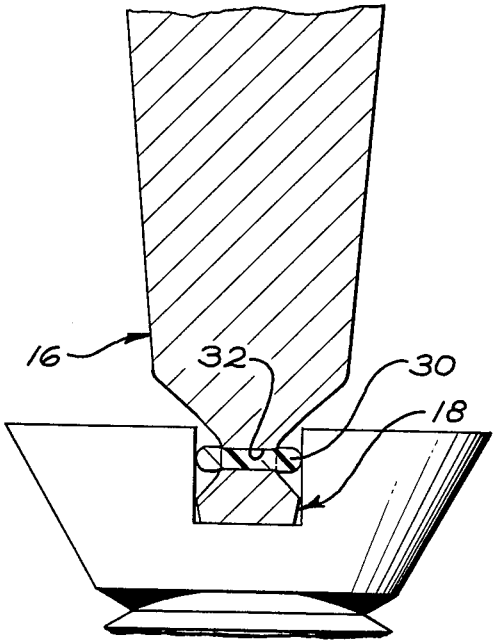
FIG. 5 is a cross-sectional view taken along the line 5—5 in FIG. 4.

FIG. 1 shows a screw driver 10 having a handle 12, a shank 14 and a blade 16. The blade 16 terminates at its free end in a foot portion 18 which is interconnected to the blade via a smooth transition portion 20. Transition portion 20 is most expediently formed by providing a generously radiused portion in the opposed major faces 22 of the blade.

Included in foot portion 18 is gripping means 24 which is comprised of upstanding sidewalls 26. Sidewalls 26 are of a preselected height which is less than the depth of the screw slot into which it is inserted. Thus, each upstanding sidewall defines a torque transmitting surface which is smaller in size than the corresponding surface of the parallel sidewall of the screw slot which it engages. It is important to note that when a torque is applied to screw driver 10, the force transmitted by the upstanding sidewalls of the foot portion is extremely large, measured in pounds per square inch. Thus, it has been found that the upstanding sidewalls actually become imbedded in the parallel sidewalls of the screw head during use of the screw driver. Such imbedding is advantageous in that it is then very difficult for the screw driver to slip from the screw slot. Further, a major portion of the torque is transmitted through the upstanding faces and only a minor portion of the torque is transmitted by the upper portion of the blade. As a consequence, the possibility of burring the upper edges of the screw slot is virtually eliminated.

In considering the upstanding sidewalls of the foot portion of the present screw driver, it should be noted that they may be either sloped upwardly and outwardly from the longitudinal axis of the shank or upwardly and inwardly. It has been noted that sloping the upstanding faces in the range of 10° or less has produced the most effective results. Similarly, upstanding faces of about 1/16 inch in height have been found to be most effective. It has further been noted that biting of the foot portion into the screw slot sidewalls is enhanced if the upstanding sidewalls are sloped upwardly and inwardly, while, holding of the screw on the screw driver has been enhanced if the upstanding sidewalls are sloped upwardly and outwardly.

Also, it should be noted that the providing of the upstanding sidewalls in place of sharp wedge-like bites of previous designs increases the wearability of the foot portion. Specifically, the upstanding sidewalls provide a larger wear surface than the wedge-like bites of the previous screw driver designs.

Another advantage, which is attendant with the present design having the upstanding sidewalls tapering upwardly and outwardly, is that the lowermost extremity of the foot portion is narrower than the portion immediately thereabove. The screw driver blade is more easily inserted, in interference fit, into a range of various sized screw slots to provide a gripping of the screw associated therewith. In the alternative, if screws with uniformly sized screw slots are used, it will be realized that interference fit type gripping by the foot portion will still exist even after considerable use of the screw driver.

Figure 6:
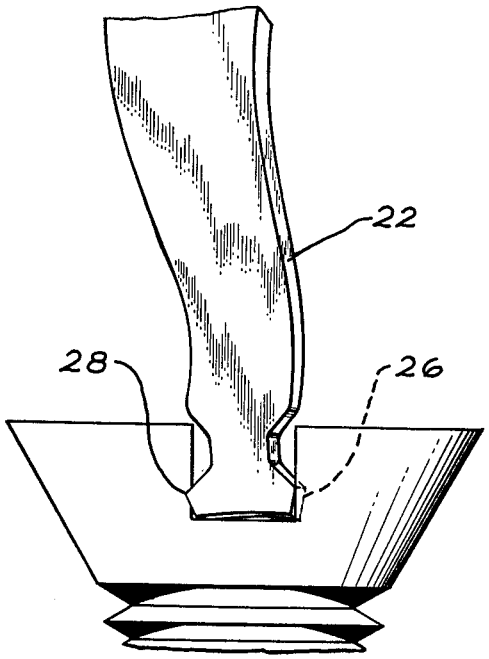
FIG. 6 is a side view showing the screw driver of FIG. 2 with torque being applied.

Also, it should be noted that shoulders 28 of the present design are very desirable in the present screw driver. Specifically, these shoulders serve to bite into the screw slot sidewalls when torque is applied to the screw driver. Thus, the blade is even more resistant to slipping out of the screw slot. Advantageously, this enhanced resistance to slipping is realized when shoulders are present in either the embodiment where the upstanding sidewalls taper upwardly and inwardly or outwardly. The reason that this resistance to slipping is realized in both embodiments is that when torque is applied to the shank and transmitted by the blade, the lower portion of the blade and the foot portion tend to twist into a drill-like configuration thereby causing shoulders 28 to dig into the screw slot sidewalls as shown in FIG. 6.

Lastly, it has been found to be advantageous to provide a resilient holding element 30 immediately above the foot portion to enhance gripping of screws having slots which are wider than the maximum breadth of the foot portion. The holding element 30 can comprise any resilient material. Polymeric resinous materials, commonly referred to as plastics, are especially suitable. Examples of such materials include, without limitation, polypropylene, polyethylene, polystyrene, ABS polymer and various copolymers and combinations thereof.

Holding element 30 can be attached to the blade in various ways which would occur to those skilled in the art. As shown in the drawing, holding element 30 is attached by providing an orifice 32 in the blade transition portion immediately above the foot portion and inserting a plastic rod therethrough and then rounding over or providing heads on each end of the rod.

Holding element 30 does not function to any appreciable extent to transmit torque to the screw head but rather it merely engages the opposed sidewalls by interference fit. It, thus, allows the user of the screw driver to quickly and easily place a screw in position on the screw driver and insert the screw into a hole that might otherwise be inaccessible.

Having thus described the invention, what is claimed is:

1. A screw driver for use in combination with a screw comprising: a shank portion and a blade portion integral therewith, said blade portion terminating at its free end in a foot portion, said foot portion being integral through a smooth transition portion with said blade and being generally pentagon shaped in side cross-section with one side defining a base portion lying in a plane generally perpendicular to the axis of the shank and being engagable with the bottom of a slot having generally parallel sidewalls of a preselected depth in a screw head, said foot portion further having two opposed sides defining upstanding faces adjoining the base of the foot portion and extending across the entire width of the blade, said upstanding faces being of a height less than the depth of said screw slot and thereby engagable with at least the lower portion of said parallel sidewalls of said screw slot to transmit torque thereto, said upstanding faces sloping outwardly and upwardly from the base of said foot portion and terminating respectively at inwardly sloping sidewalls which define the uppermost portion of said foot portion, said inwardly sloping sidewalls extending the entire width of said blade and being integral with said transition portion which, in turn, is integral with said blade.

2. The screw driver of claim 1 wherein said smooth transition portion is a generously radiused portion.

3. The screw driver of claim 1 wherein said upstanding faces are about 1/16 inch in height.

4. The screw driver of claim 1 wherein said upstanding faces of said foot portion terminate at said inwardly sloping sidewalls to define a shoulder extending across the width of the blade.

* * * * *